US007103187B1

(12) United States Patent
Neuman

(10) Patent No.: US 7,103,187 B1
(45) Date of Patent: Sep. 5, 2006

(54) AUDIO CALIBRATION SYSTEM

(75) Inventor: Darren D. Neuman, San Jose, CA (US)

(73) Assignee: LSI Logic Corporation, Milpitas, CA (US)

( * ) Notice: Subject to any disclaimer, the term of this patent is extended or adjusted under 35 U.S.C. 154(b) by 0 days.

(21) Appl. No.: 09/281,365

(22) Filed: Mar. 30, 1999

(51) Int. Cl.
*H04R 29/00* (2006.01)

(52) U.S. Cl. ..... 381/59; 381/109

(58) Field of Classification Search ..... 381/103, 381/104, 109, 303, 59, 97
See application file for complete search history.

(56) References Cited

U.S. PATENT DOCUMENTS 5,386,478 A * 1/1995 Plunkett ..... 381/103
5,778,087 A * 7/1998 Dunlavy ..... 381/303

* cited by examiner

*Primary Examiner*—Ping Lee
(74) *Attorney, Agent, or Firm*—Conley Rose, P.C.

(57) ABSTRACT

An audio calibration system includes control logic, an input device, a display, a noise generator, an inverter, a plurality of speakers, and a delay module coupled to each speaker. Upon receipt of a calibration start signal from the input device, the control logic directs the noise generator to produce substantially random noise which is then provided through the delay modules to each speaker. The inverter inverts the random signal to one of the speakers. Thus, in a two speaker system the sound emanating from one of the speakers is an inverted version of the sound emanating from the other speaker. At the points where the sound from each speaker combine, a "null" line is created as the two sources of sound cancel one another. The control logic controls the amount of delay introduced by each delay module into the sound provided to each speaker. By varying the amount of the time delay, the control logic can control the position of the null line to coincide with a listener's desired listening location. The preferred embodiment can be extended into a surround-sound system comprising five speakers. Each audio channel may include a time delay and the audio calibration system can be used to calibrate the null line produced by pairs of speakers.

17 Claims, 9 Drawing Sheets

FIG. 2A
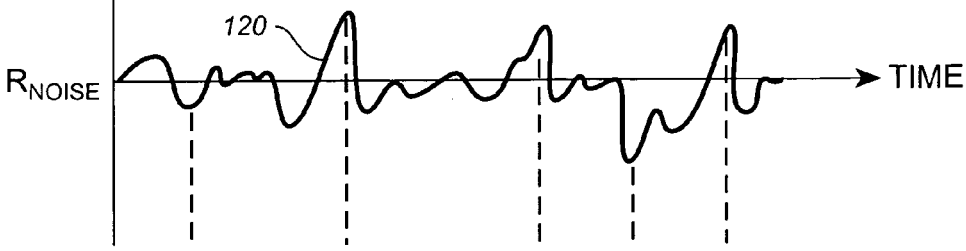
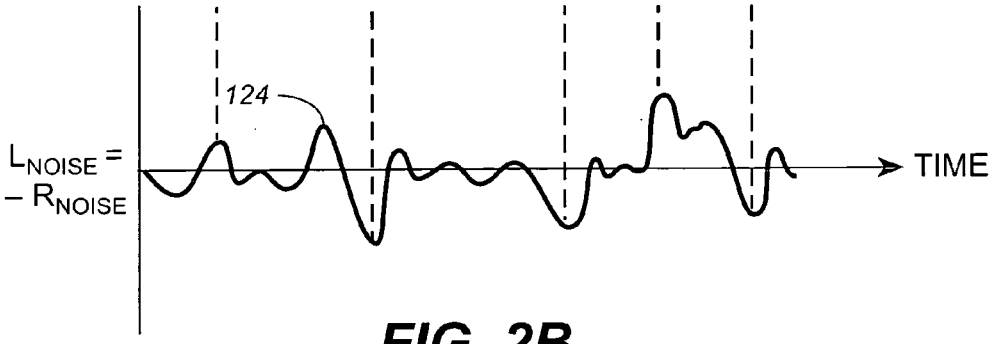
FIG. 2B

AUDIO CALIBRATION SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention generally relates to an audio calibration system and more particularly to a technique for calibrating an audio system for any desired listening location. Still more particularly, the invention relates to a method and apparatus for tuning an audio system to cause a "null" point to be located at any desired location in the room.

2. Background of the Invention

Audio systems are designed to reproduce sound. Stereo systems, for example, reproduce sound from compact discs (CDs), cassette tapes, radio transmissions, and the like. Regardless of whether the audio system is a stand-alone stereo system, an audio system incorporated into a personal computer, or any other type of audio system, it is desirable to reproduce the sound as accurately as possible. Thus, audio systems are designed to recreate sound that is as close to the original recorded sound as possible.

Audio systems include a speaker, or other type of sound generating device, that converts an electrical signal into sound waves that emanate from the speaker, travel through the air, and into a person's ears. Audio systems include at least one speaker, and often include two or more speakers for stereo sound. A surround-sound system, for example, typically includes five speakers.

Sound takes a finite amount of time to travel between two points. The speed of sound through air at ground level is approximately one foot per millisecond. Thus, if a sound pulse emanates from two speakers at precisely the same instant in time, the sound pulse from both speakers will arrive at precisely the same time to a person that it is an equal distance from each speaker. If, however, that person is closer to one speaker than the other speaker, the sound pulse from the closer speaker or will arrive to the person before the samples from the other speaker, thereby causing a distortion in the perceived sound by the person. This problem is exacerbated in a surround-sound system in which the person listening to the system is located at different distances from each speaker.

One approach to solving this problem is to manually place each of the speakers connected to the audio system at an equal distance from where the listener is located. If the listener typically listens to music while sitting in a particular chair in a room, each of the speakers will be positioned the same distance from the listener's chair. However, if the listener wishes to listen to music from another position in the room, the speakers may have to be physically moved to calibrate the system to the new location. While the resulting sound quality is generally adequate, this technique often is difficult to implement because furniture in the room and other room specific factors may preclude conveniently locating speakers at equal distances from the listener's chair.

Also, many people have speakers that are large enough to preclude being conveniently located in many locations in a room.

Another approach that has been suggested is to measure the distance between the listener's location and each speaker, calculate the difference between those distances, and introduce a time delay into the audio channel corresponding to the closer speaker. Thus, if the left speaker, in a two speaker system, is measured as being three feet closer to the listener than the right speaker, a technician programs a 3 millisecond time delay into the left audio channel. Three milliseconds is chosen in this example because at a speed of 1 foot per millisecond, it will take sound an extra 3 milliseconds to travel from the right speaker to the listener. The time delay in the left audio channel compensates for the difference in distance between the speakers and the listener. This technique usually requires a skilled technician to setup the audio system and thus, is expensive to perform and adjust if the listener wishes to change his or her listening location.

Thus, an improved technique for calibrating an audio system to a listener's location is needed. The new technique should be easy to perform and preferably not require a highly skilled technician. Despite the advantages such an audio calibrating system would offer, to date no such system is known to exist.

BRIEF SUMMARY OF THE INVENTION

The deficiencies noted above are solved in large part by an audio calibration system generally comprising control logic, an input device, a display, a noise generator, an inverter, a plurality of speakers, and a delay module coupled to each speaker. Upon receipt of a calibration start signal from the input device, the control logic directs the noise generator to produce substantially random noise which is then provided through the delay modules to each speaker. The inverter inverts the random signal to one of the speakers. Thus, in a two speaker system the sound emanating from one of the speakers is an inverted version of the sound emanating from the other speaker. At the points where the sound from each speaker combine, a null line is created as the two sources of sound cancel one another. The control logic controls the amount of delay introduced by each delay module into the sound provided to each speaker. By varying the amount of the time delay, the control logic can control the position of the null line to coincide with a listener's desired listening location.

The preferred embodiment can be extended into a surround-sound system comprising five speakers. Each audio channel may include a time delay and the audio calibration system can be used to calibrate the null line produced by pairs of speakers. These and other advantages will become apparent once the following disclosure and accompanying drawings are read.

BRIEF DESCRIPTION OF THE DRAWINGS

For a detailed description of the preferred embodiments of the invention, reference will now be made to the accompanying drawings in which:

FIG. 2 shows the random or pseudo-random noise signals generated by the audio calibration system of FIG. 1 that are used in the calibration process;

Certain terms are used throughout the following description and claims to refer to particular system components. Often, many companies in an industry refer to the same component by different names. This document does not intend to distinguish between components that differ in name but not function. In the following discussion and in the claims, the terms "including" and "comprising" are used in an open-ended fashion, and thus should be interpreted to mean "including, but not limited to . . . ". Also, the term "couple" or "couples" is intended to mean either an indirect or direct electrical connection. Thus, if a first device couples to a second device, that connection may be through a direct electrical connection, or through an indirect electrical connection via other devices and connections.

DETAILED DESCRIPTION OF THE PREFERRED EMBODIMENTS

Figure 1:
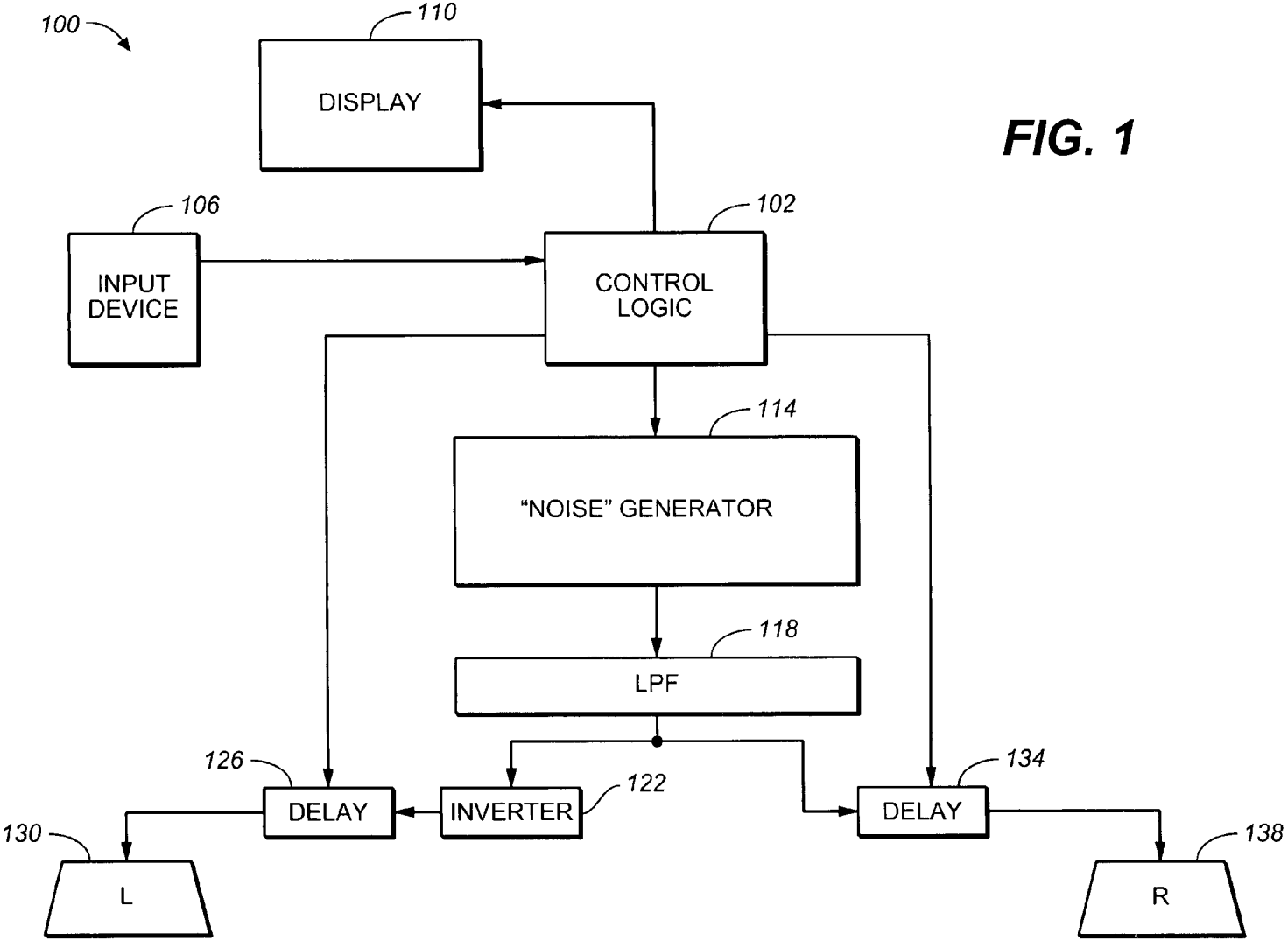
FIG. 1 shows an audio calibration system constructed in accordance with the preferred embodiment.

Referring now to FIG. 1, an audio calibration system 100 constructed in accordance with the preferred embodiment generally includes a control logic 102, an input control device 106, a display 110, a noise generator 114, a low pass filter 118, an inverter 122, delays 126 and 134, and left and right speakers 130 and 138, respectively. The control logic unit 102 couples to the input device 106, display 110, noise generator 114, and time delays 126, 134. The noise generator 114 couples to the low pass filter 118 which, in turn, couples to the inverter 122 and delay 134. Time delays 126, 134, which can be implemented with any suitable technique such as a first in first out (FIFO) buffer, are controlled independently by control logic 102 to introduce varying amounts of time delay into the audio signals provided to each speaker 130, 138. The output signal from delay 134 is provided to the right speaker (R) 138.

The control logic 102 can be any suitable microcontroller such as a digital signal processor (DSP) manufactured by LSI Logic, a DSP integrated within another audio device, or a discrete logic circuit for controlling operation of the audio calibration system 100 according to the principles described below. The input device 106 is used to provide a control signal to control logic 102 for calibrating the audio system. The input device 106 can be any suitable input control device such as a computer joystick, a television or VCR remote control, or any other control device capable of providing at least two control signals to control logic 102. The input device may be hard-wired directly into the control logic or have a wireless interface such as through well known RF or infrared communication techniques. A "universal" remote control capable of controlling multiple electronic devices is acceptable. Universal remotes typically have an "auxiliary" setting for controlling any desired device in addition to predetermined settings for a television, VCR, and cable box. The auxiliary setting can be used to provide control signals to the control logic 102.

Figure 1A:
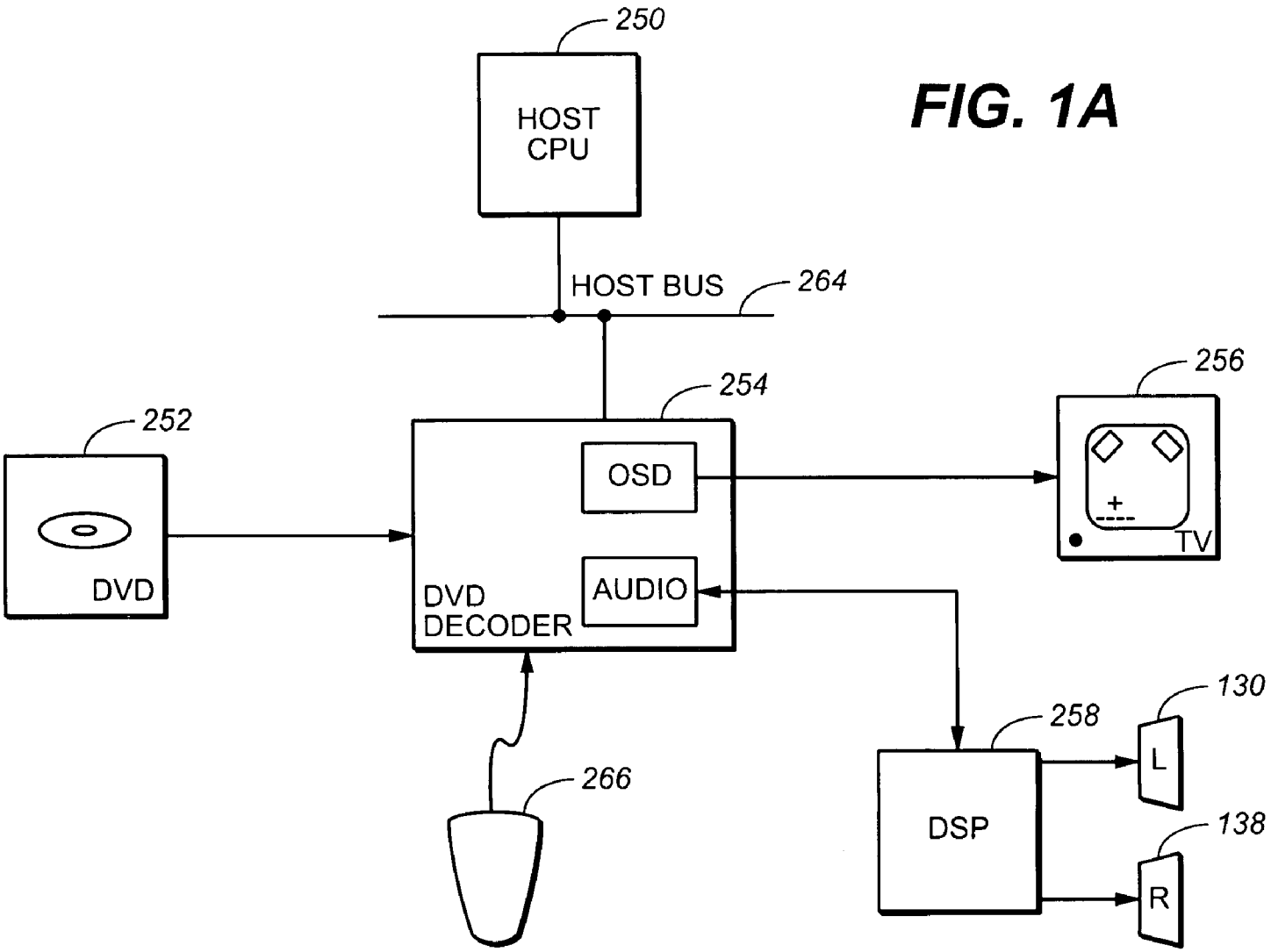
FIG. 1A shows an alternative embodiment of the audio calibration system using a digital video disk decoder and a digital signal processor.

An alternative embodiment of audio calibration system 100 is shown in FIG. 1A. As shown, this embodiment includes a host CPU 250, a digital video disk player (DVD) 252, DVD decoder 254, a television (TV) 256, DSP 258 and left and right speakers 130, 138. The host CPU 250 communicates with the DVD decoder 254 over host bus 264. The DVD decoder also couples to the DVD player 252, TV 256, and DSP 258 as shown. The DSP 258 generates the audio signals provided to speakers 130, 138. The DVD decoder 254 preferably includes an on-screen display (OSD) controller 260 and an audio decoder 262 which interfaces to DSP 258. The OSD controller 260 generates video signals which are provided for display on TV 256. The following discussion focuses on the embodiment shown in FIG. 1, but it should be understood that the invention can be implemented with the embodiment of FIG. 1A, or any other suitable architecture.

The display 110 preferably comprises any suitable type of visual device. For example, the display may include a television or computer monitor. Further, display 110 may comprise a display integrated into audio equipment such as a stereo receiver, VCR, or digital video disk (DVD) player. The display 110 need only be sufficient to provide visual feedback to the user during the audio calibration process as described below.

Figure 5:
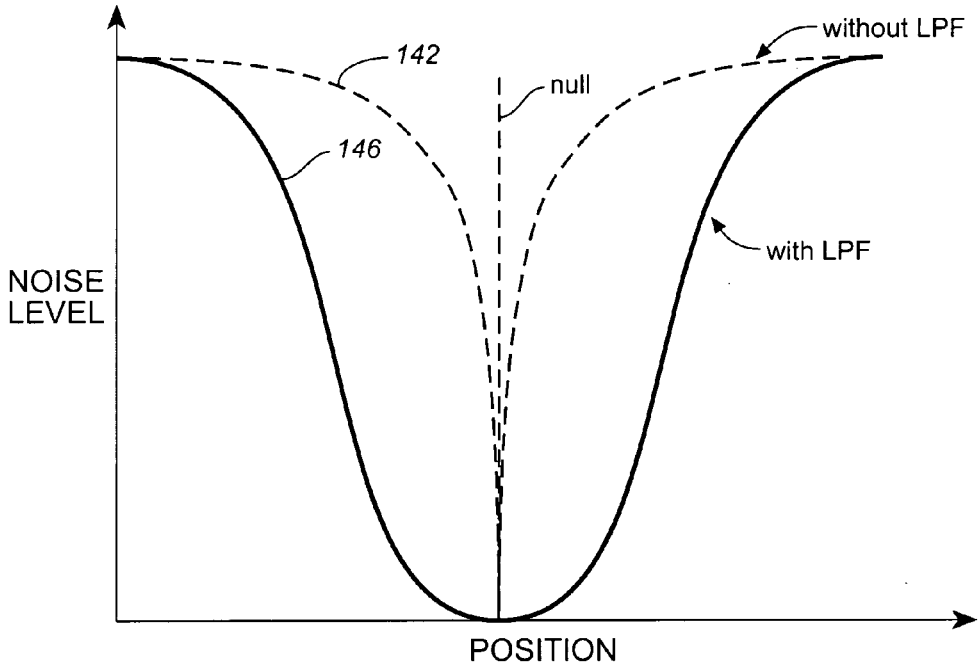
FIG. 5 shows the amplitude of the noise with respect to position illustrating the null line both with and without low pass filtering.

To begin the calibration process, the user operates the input control device 106 to transmit or assert a begin calibration signal to the control logic 102. In response, control logic 102 provides a control signal to the noise generator 114. The noise generator then produces substantially random noise. Random noise is noise whose autocorrelation is zero. The noise signal may also be pseudo-random which is approximately random and is easily generated using conventional techniques such as that described in The Art of Electronics, $2^{nd}$ edition, Cambridge University Press, 1989, pages 430–433, 654–667, incorporated herein by reference. Any other type of signal that can cause a single "null" line or point as described below can also be used. Generally, the signal will have no significant autocorrelation value within the wavelength limits of the room size. For purposes of discussing the preferred embodiment, the following discussion refers to a random noise signal. The noise produced by noise generator 114 preferably is filtered by low pass filter 118, although filtering is not required. The benefit of low pass filtering the noise signal is illustrated in FIG. 5 and is discussed below.

After being filtered by low pass filter 118, the low pass filtered random noise signal is provided to inverter 122 and to delay 134. Inverter 122 inverts the filtered signal as is shown in FIG. 2. An exemplary portion of the filtered random noise signal provided to delay 134 associated with the right speaker is illustrated in FIG. 2A. FIG. 2B represents the same random signal as in FIG. 2A, but inverted by inverter 122. Any suitable inverter circuit can be used such as an operational amplifier manufactured by Analog Devices. Optionally, inversion can be accomplished digitally in a DSP. In that case, inversion refers to sign inversion of the audio samples. In fact, if the embodiment of FIG. 1A is used, the DSP 258 preferably generates the random noise and delay and performs inversion.

Figure 3:
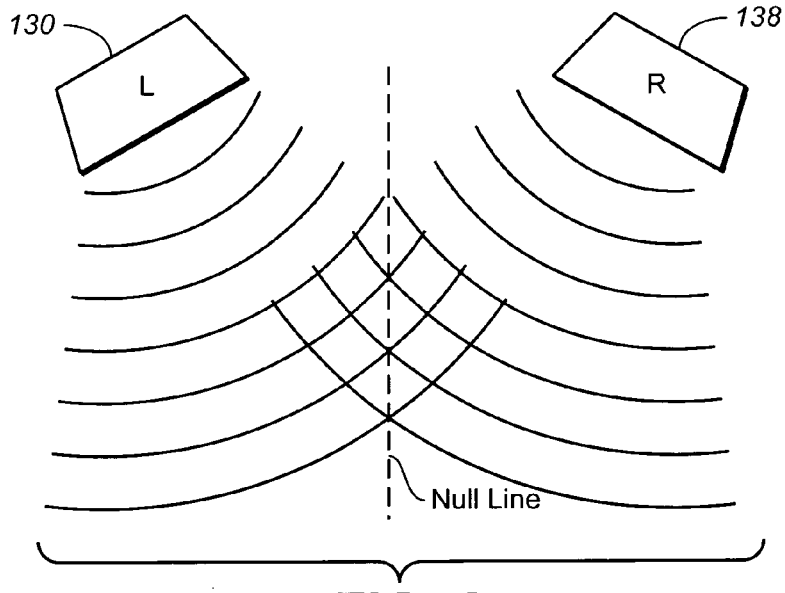
FIG. 3 illustrates a "null line" in a two speaker audio system.

Referring now to FIGS. 2A, 2B, and 3, the effect of providing the random noise signal to the right speaker and an inverted version of the same random signal to the left speaker is that when the two signals are broadcast at identical volumes through the speakers 130 and 138, the two random audio noise signals will cancel each other at various points in the room. As shown in FIG. 3, an imaginary line will exist along which the sound is greatly attenuated because the two noise signals have cancelled each other. That line is called the "null line" and represents the set of points at which the Rnoise+Lnoise=0. Although sound is emanating at normal volume from both speakers, the volume level will be much lower, if not 0, along the null line.

The audio calibration system 100 generally is used to calibrate or tune the audio system to cause the null line to coincide with the listener's preferred listening location. Because the sound waves that emanate from each speaker travel through air at the same speed, approximately 1 foot/millisecond, the two random noise signals will combine essentially to zero at points that are an equal distance from each speaker. Thus, as shown in FIG. 3, the null line is located at the geometric center line between the two speakers. That is, the distance from any point on the null line to either speaker is exactly the same. A listener located along the null line will hear sound, arriving from one speaker at the same time as comparable, univerted sound from the other speaker. As the listener moves away from the null line shown in FIG. 3, the listener will hear sound from the closest speaker before hearing the comparable sound from the farthest speaker, even though the sound was generated by both speakers at exactly the same time.

Figure 4:
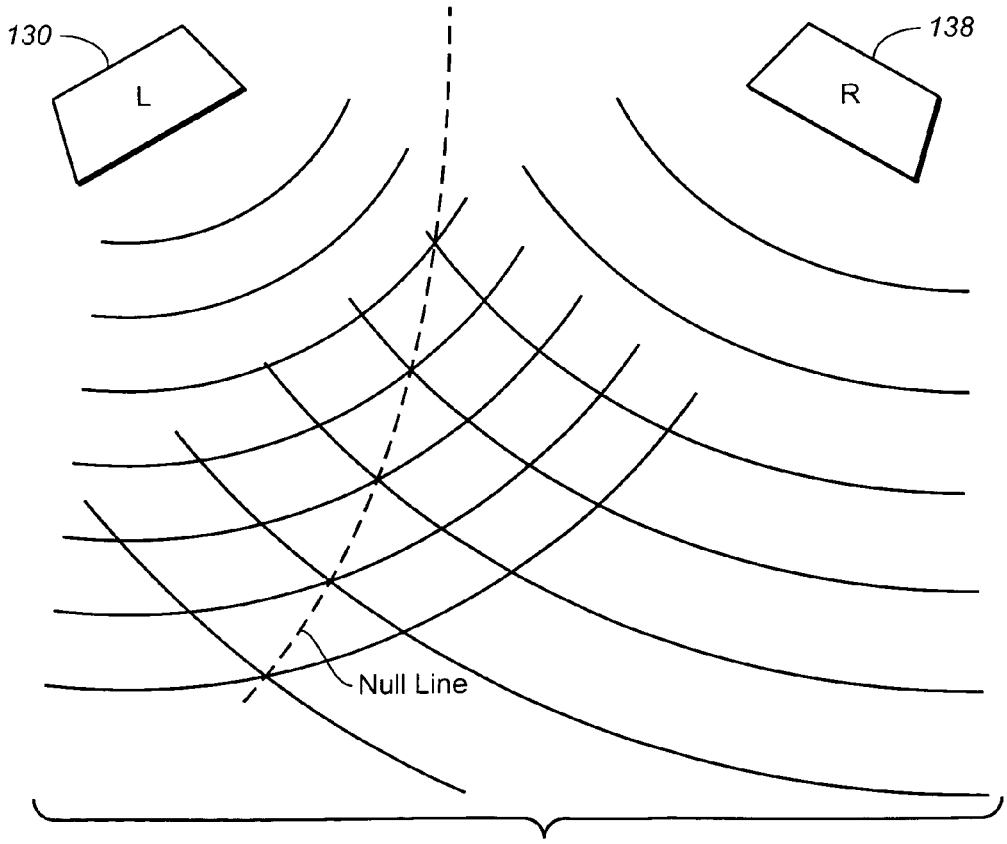
FIG. 4 illustrates the change in position of the null line caused by a time delay in one of the audio channels.

In accordance with the preferred embodiment, the audio calibration system includes programmable time delay modules 126 and 134 which cause a time delay to be introduced into associated audio channel. Referring to FIG. 4, for example, a time delay has been introduced into the left channel using delay 126. This delay causes the null line to curve and to shift to the left closer to the left speaker 130. Varying the amount of the time delay permits the null line to be positioned to intersect at any desired location. Introducing a delay in the right channel using delay 134 shifts the null line closer the right speaker 138. The null line represents the optimal listening location because at that location the effect of differences in distance between the speakers and the listener has been removed.

Referring again to FIG. 1, the listener can control the location of the null line using input device 106. If the input device includes a remote control such as that used with a television, VCR, or DVD player, the listener can control the left and right movement of the null line during the calibration process using the left and right arrow keys which are typically provided on the remote control to change, for example, the channel. Accordingly, if the listener wishes to tune the audio system so that the null line is closer to the left speaker, the listener may press the left arrow key. However, if the listener's location is closer to the right speaker, the listener may press the right arrow key. Rather than a typical television remote control, the input device 106 may comprise a joystick and thus, the null line location can be adjusted by moving the stick either to the right or left. Any type of input control device that can signal the control logic 102 to program either delay 126 or 134 to move the null line in either direction is suitable and consistent with the preferred embodiment of the invention.

The listener preferably tunes the audio system by moving the null line one way or the other until the sound level heard by the listener drops to a minimum level. FIG. 5 graphically illustrates sound level amplitude versus distance of the listener away from the null line both without the low pass filter 118 (curve 142) and with the low pass filter (curve 146). In either case, at locations near the null line, the sound volume begins to reduce. At the null line, the sound volume drops to a minimal level. Without the low pass filter, the sound level does not begin to reduce until the listener is closer to the null line than if the random noise signal is low pass filtered. Accordingly, the low pass filter 118 preferably "widens" the region of reduced sound level on either side of the null line to facilitate detecting the null line as the user controls the delays.

Figure 6:
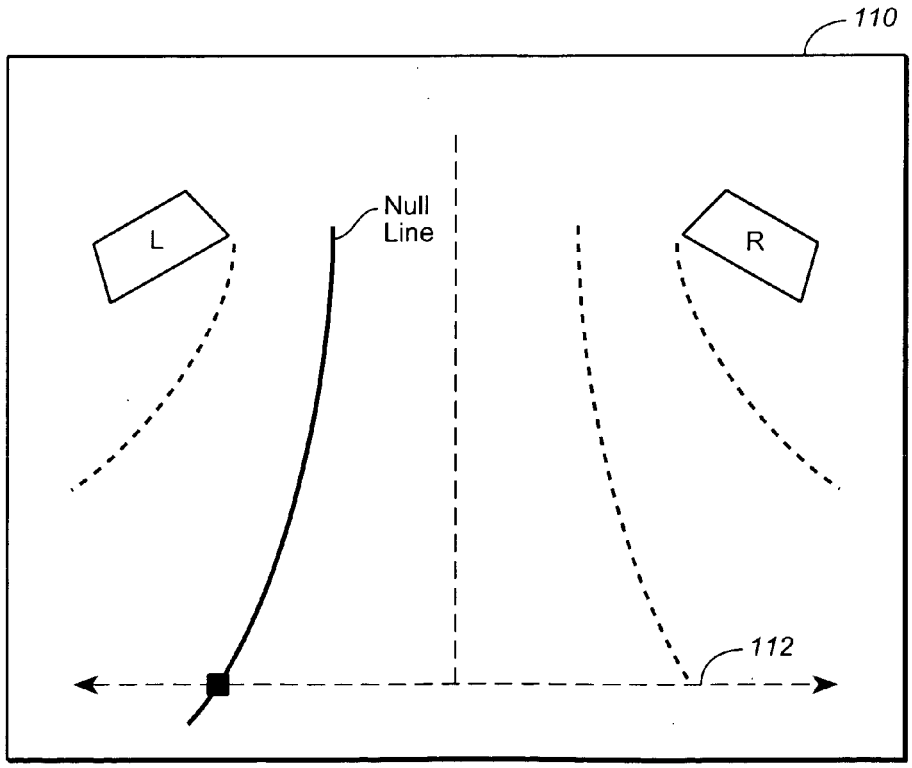
FIG. 6 shows a graphical image of the relative location of the null line for providing visual feedback to the user during the calibration process.

Some form of visual feedback may be helpful to the listener to control the location of the null line. In accordance with the preferred embodiment, a graphical image such as that shown in FIG. 6 is shown on display 110 to illustrate the relative location of the null line. If the input control device 106 includes a television remote control, the null line graphically shown can be moved to the left or right by pressing, for example, the left or right arrow keys as described above. The movement of the null line on the display 110 as the user operates the control device 106 provides feedback to the user that the calibration system is responding to the user's control signals as well as indicating the relative position of the null line. This procedure helps a user to find the null location because outside the null all the user hears is noise, so the relative location of the null may be difficult to find. By including graphic feedback, the relative position of null more easily can be found.

Any mechanism to initiate the calibration sequence is permissible. For example, if a television-type remote control is used, any one of the buttons can be pre-programmed to signal the control logic 102 to begin calibration. Various other audio components not shown in FIG. 1 can be deactivated at that point and the calibration system shown in FIG. 1 preferably is activated.

The principles described above can be extended to audio systems that have more than two speakers. With more than two speakers, the audio system will generally have a "null point" rather than a null line. Thus, there will be a single point at which sound from each speaker arrives simultaneously relative to the source of the sound.

Figure 7:
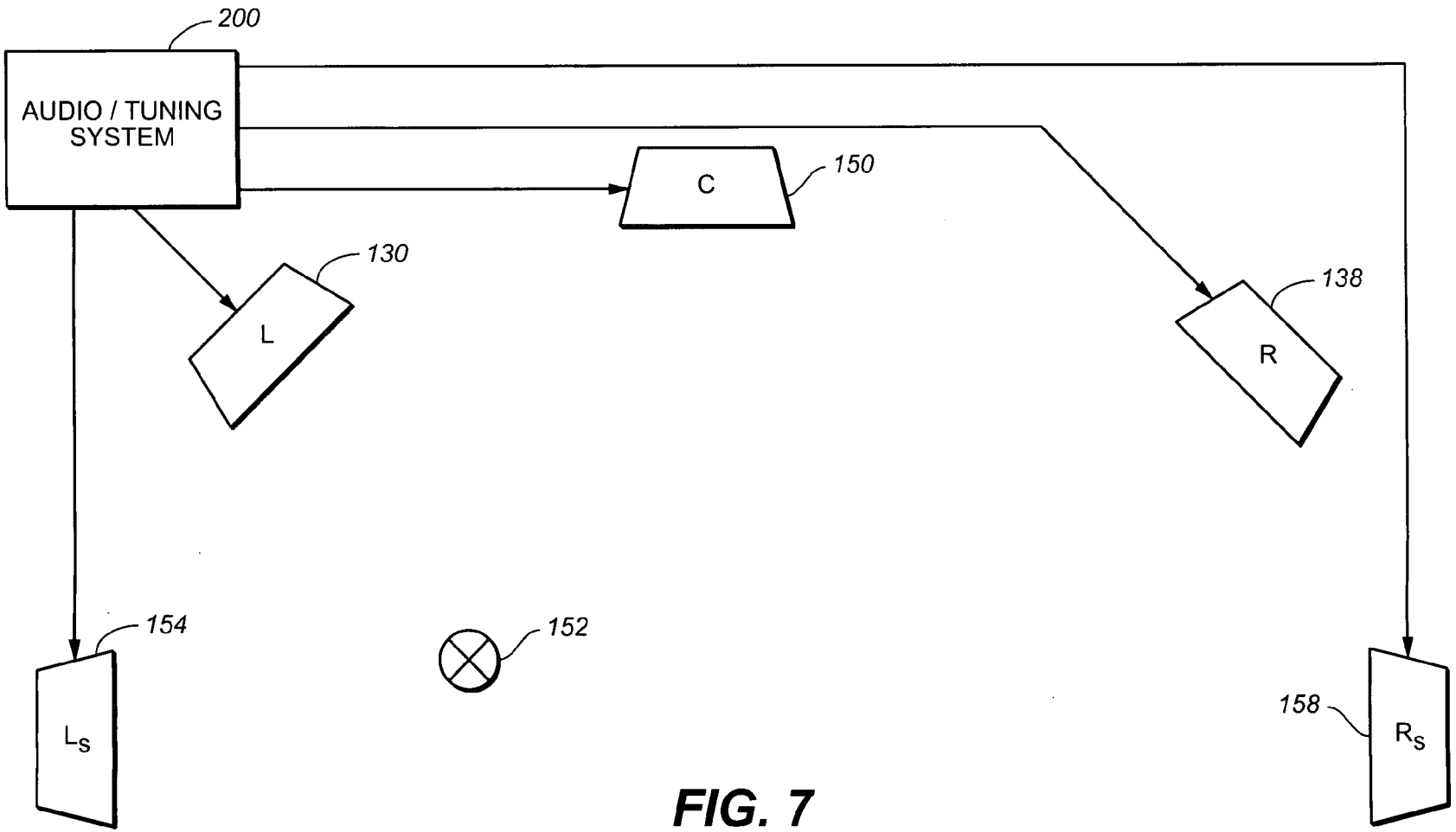
FIG. 7 shows an exemplary placement of speakers in a five speaker audio system.

In FIG. 7, an audio/tuning system 200 is shown connected to five speakers in an exemplary "surround-sound" environment. The speakers include a left surround-sound speaker 154 (Ls), a left speaker 130 (L), a center speaker 150 (C), a right speaker 138 (R), and a right-surround-sound speaker 158 (Rs). A listener's desired listening location is denoted at point 152. That is the point at which the audio system's null point preferably is located. The audio/tuning system 200 permits the null point to be positioned dynamically at point 152 as described below.

Figure 8:
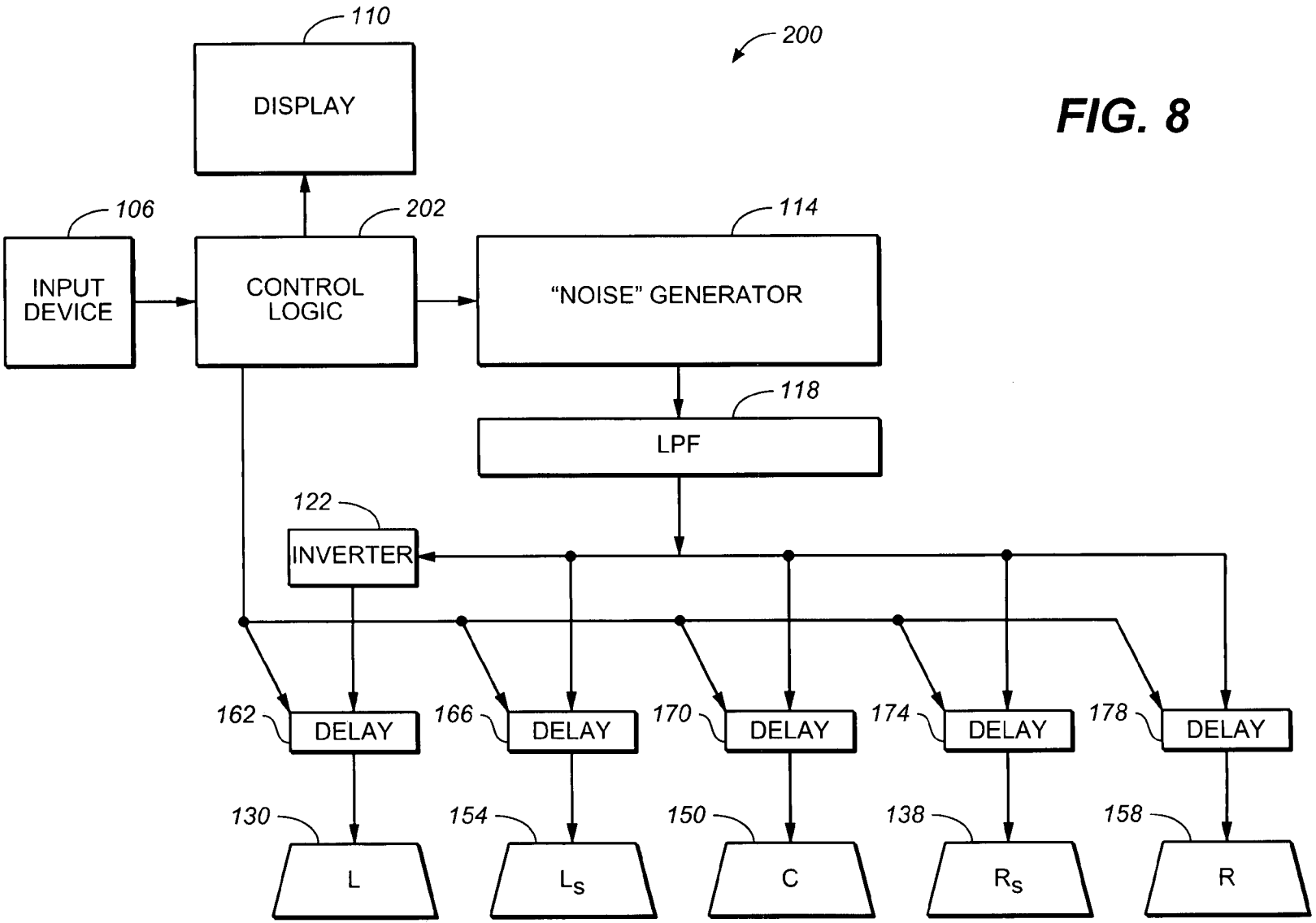
FIG. 8 shows an audio calibration system used to calibrate the exemplary five speaker system shown in FIG. 7.

An exemplary embodiment of audio/tuning system 200 is shown in FIG. 8. As shown, the system 200 preferably includes control logic 202 coupled to an input control device 106, a display device 110, a noise generator 114, a low-pass filter 118, and delay modules 162, 166, 170, 174, and 178. Each delay module couples to a speaker. Thus, delay module 162 couples to left speaker 130 and delay module 166 couples to left surround sound speaker 154. Further, delay modules 170 couples to center speaker 150. Finally, delay modules 174 and 178 couple to right surround sound speaker 138 and right speaker 158, respectively. Control signals from the control logic control the amount of delay, if any, each delay module provides in its corresponding audio channel.

Figure 9:
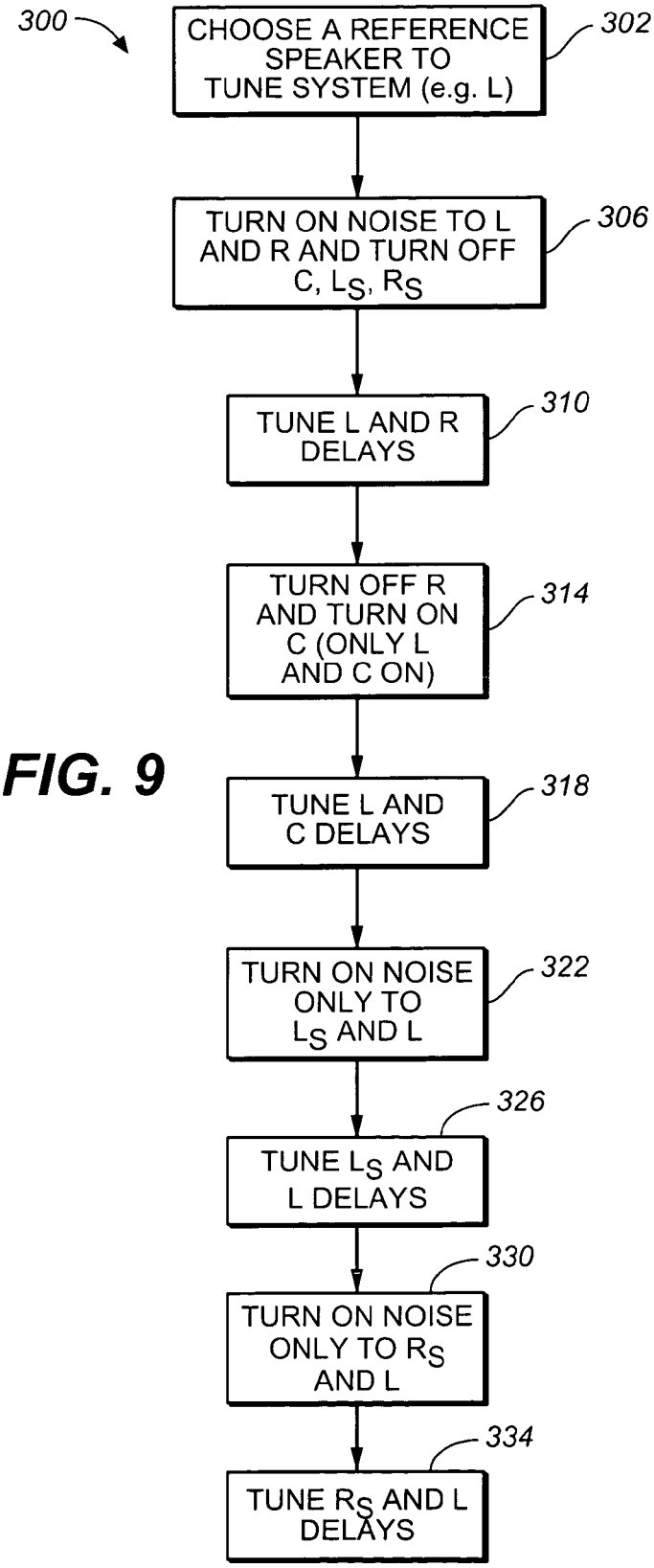
FIG. 9 shows the method for calibrating the five speaker system of FIG. 7 using the audio calibration system shown in FIG. 8.

An exemplary method of operation of audio/tuning system 200 is shown in the flow chart 300 of FIG. 9 and explained with reference to FIG. 8. The steps shown are exemplary only of one possible embodiment of the method. The order of the steps can be changed from that shown and other steps can be substituted for those shown without departing from the spirit of the invention. In the first step 302, one of the speakers (e.g., left speaker 130) is chosen as a reference for the tuning process. The selection of which speaker to choose as the reference is not critical; any of the speakers can be chosen as the reference.

In step 306, the noise generator 114 is activated to provide random or pseudo-random noise to the left and right speakers 130, 138. Accordingly, the center and left and right surround-sound speakers 150, 154, 158 are turned off. Turning off a speaker can be accomplished in any of a number of ways. For example, the control signals from the control logic 202 to the delay modules can be encoded to preclude the audio signals from passing through the delay modules to the speakers.

In step 310 the delay modules 162, 178 coupled to the left and right speakers 130, 158 are tuned so as to position the null line with respect to those speakers through the listener's location (position 152 in FIG. 7). Then, in step 314 the right speaker is turned off and the center speaker 150 is turned on. At this point only the left and center speakers 130, 150 generate random noise sound. In step 318 a null line is tuned with respect the center and left speakers by adjusting delays 162, 170.

In step 322 random noise is turned on only to the left speaker 130 and left surround-sound speaker 154 and in step 326 a null line is positioned with respect to the two left speakers by tuning the delay modules 162 am 166. Steps 322 and 326 effectively are repeated as steps 330 and 334 but with perspective to be right surround sound and left speakers 138 and 130. The result of these steps this to calibrate the null line with respect to various pairs of speakers through the listener's desired listening location (position 152). Because the resulting null lines will all intersect substantially at position 152, the result is a null point at position 152.

After the user has tuned the null line in each step, 310, 318, 326, and 334, control passes to the next step preferably after the user activates input control device 106 to signal the control logic 202 of the completion of each tuning step.

Figure 10:
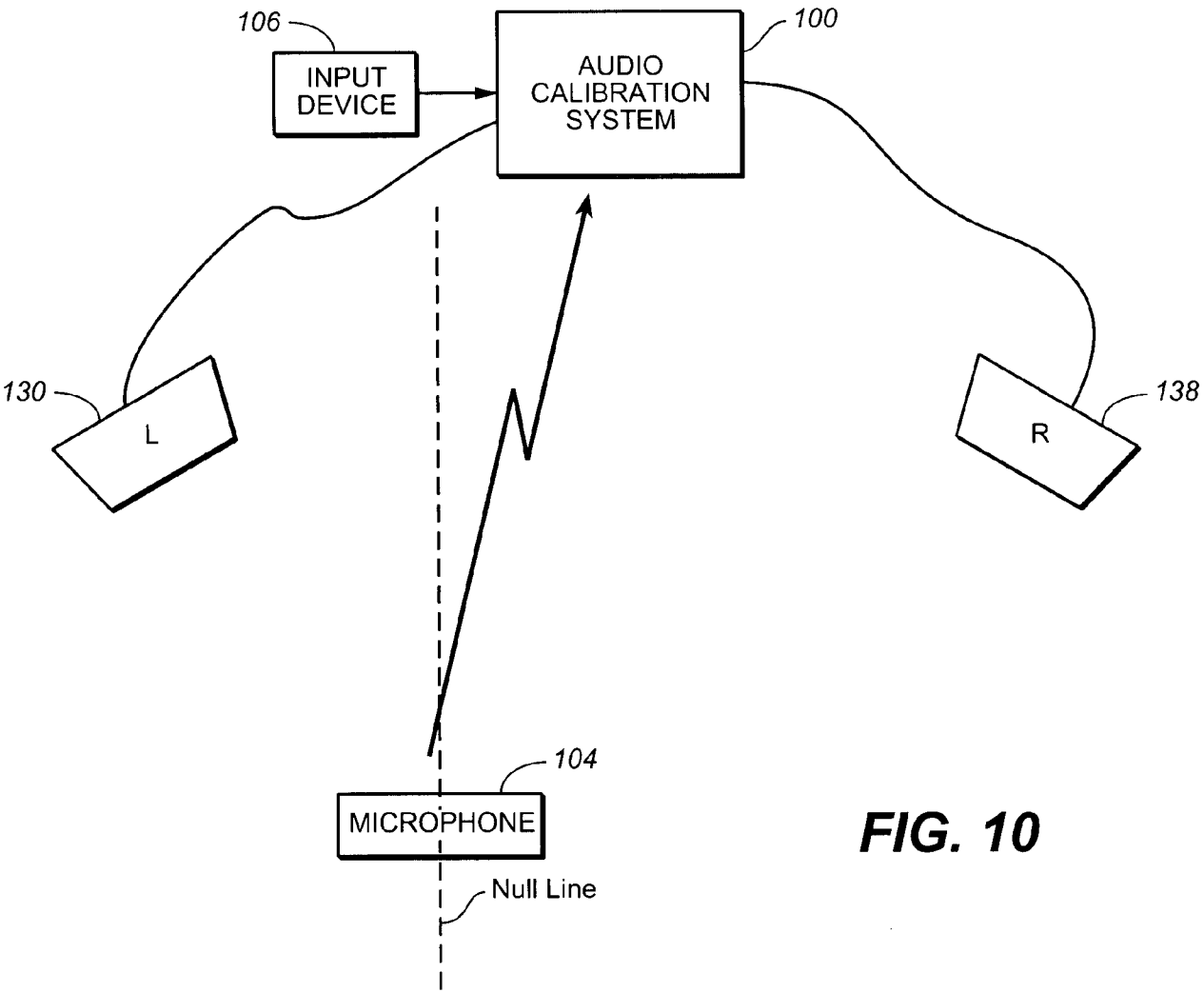
FIG. 10 shows an alternative embodiment using a sound detector to calibrate automatically the audio system to a desired listener location.

An alternative embodiment includes electronic processing of the random noise sound to detect the null points, rather than a human listening for the null points. In this alternative embodiment, illustrated schematically in FIG. 10, a sound detector such as microphone 104 is positioned at the listener's desired listening location and the listener initiates the calibration process by activating a control input device 106.

The microphone 104 provides the detected audio signal to the audio calibration system 100 and the control logic included therein processes the signal and adjusts the delays 126, 134. When the control logic detects a minimum sound level, the control logic determines that the null line coincides with the location of the microphone. The minimum point can be determined with any suitable technique such as point-by-point comparison or by computing the first derivative of the audio signal and determining when the derivative value is approximately zero. This alternative embodiment can also be used in the five speaker calibration system of FIG. 8, as well as with any other number of speakers.

The embodiments described above can be implemented in hardware or software. In a software embodiment, the control logic 102, 202 represents a microcontroller than executes code implementing the functionality described above.

The above discussion is meant to be illustrative of the principles of the present invention. Numerous variations and modifications will become apparent to those skilled in the art once the above disclosure is fully appreciated. It is intended that the following claims be interpreted to embrace all such variations and modifications.

What is claimed is:

1. An audio calibration system, comprising:

a control logic;

an input device coupled to said control logic;

a display coupled to said control logic;

a noise generator for generating a substantially random noise signal and coupled to said control logic;

a plurality of speakers coupled to said noise generator; and delay modules coupled between said noise generator and said plurality of speakers for introducing time delays in the sound produced by the speakers, wherein said control logic causes said display to display a visual image that includes a null line, wherein the position of the null line is determined by the time delays of the delay modules.

2. The audio calibration system of claim 1 wherein the substantially random noise signal has an auto correlation of 0.

3. The audio calibration system of claim 1 wherein the substantially random noise signal is pseudo-random.

4. The audio calibration system of claim 1 wherein said plurality of speakers includes five speakers.

5. The audio calibration system of claim 1 wherein said input device is wirelessly coupled to said control logic.

6. An audio calibration system, comprising:

a control logic;

an input device coupled to said control logic, wherein said display displays a null line;

a display coupled to said control logic;

a noise generator for generating a substantially random noise signal and coupled to said control logic;

a plurality of speakers coupled to said noise generator;

delay modules coupled between said noise generator and said plurality of speakers for introducing time delays in the sound produced by the speakers; and an inverter coupled between said noise generator and at least one delay module.

7. The audio calibration system of claim 6 further including a low pass filter coupled between said noise generator and said delay modules for low pass filtering the noise signal.

8. An audio calibration device, comprising:

a control logic;

an input device coupled to said control logic;

a noise generator for generating a substantially random noise signal and coupled to said control logic;

a low pass filter coupled to said noise generator for filtering the random noise signal from said noise generator;

an inverter coupled to said low pass filter;

a first delay module coupled to said inverter for introducing a time delay into an output signal from said inverter; and a second delay module coupled to said low pass filter for introducing a time delay into an output signal from said filter, wherein said control logic controls the amount of time delay introduced by each delay module to thereby vary the location of a null line having a widened region of reduced sound level due to the operation of the low pass filter.

9. The audio calibration device of claim 8 further including a display unit coupled to the control logic for displaying a visual image indicative of the relative location of the null line.

10. The audio calibration device of claim 9, wherein said display unit includes an on-screen display controller implemented in a DVD decoder.

11. The audio calibration device of claim 9 further including a sound detector coupled to said control logic, said control logic determines the presence of the null line by processing an audio signal from said sound detector.

12. The audio calibration device of claim 9, wherein said noise generator and low pass filter are implemented using digital signal processing.

13. The audio calibration system of claim 9 further including speakers respectively coupled to said delay modules.

14. A method for calibrating an audio system including multiple speakers, comprising:

providing substantially random noise to a reference speaker and a first speaker;

tuning a time delay to one of the speakers provided with substantially random noise to adjust the location of a null line caused by said reference and first speakers;

providing substantially random noise to said reference speaker and a second speaker; and tuning a time delay to one of the reference or second speakers to adjust the location of a null line caused by said reference and second speakers.

15. The method of claim 14 further including:

providing substantially random noise to said reference speaker and a third speaker; and tuning a time delay to one of the reference or second speakers to adjust the location of a null line caused by said reference and third speakers.

16. An audio calibration system, including:

a means for generating a substantially random noise signal;

a delay means coupled to said noise signal generating means for introducing time delays in the substantially random noise signal;

a means for controlling the amount of time delay introduced by said delay means to control the location of a null point; and a filtering means coupled to said noise signal generating means for low pass filtering the substantially random noise signal to produce a widened region of reduced sound level.

17. The audio calibration system of claim 16 further including a means for displaying the relative location of the null point.

* * * * *